US005133162A

United States Patent [19]

Nelson

[11] Patent Number: 5,133,162

[45] Date of Patent: Jul. 28, 1992

[54] BUILDING SYSTEM

[76] Inventor: Brian A. Nelson, 9 Queen Street, South Perth, Western Australia, Australia, 6151

[21] Appl. No.: 337,642

[22] Filed: Apr. 13, 1989

[51] Int. Cl.[5] ..... E04B 7/02; E04B 7/08

[52] U.S. Cl. ..... 52/90; 52/93; 52/643

[58] Field of Search ..... 52/18, 92, 93, 639, 52/641, 643

[56] References Cited

U.S. PATENT DOCUMENTS

| | | | |
|---|---|---|---|
| 618,851 | 2/1899 | Dunbar | 52/92 |
| 1,988,388 | 1/1935 | Mioton | 52/92 |
| 2,239,399 | 4/1941 | Pandya | 52/643 X |
| 3,191,238 | 6/1965 | Olson | 52/93 X |
| 4,274,234 | 6/1981 | Abell | 52/63 |
| 4,285,182 | 8/1981 | Dinges | 52/726 X |

*Primary Examiner*—David A. Scherbel
*Assistant Examiner*—Kien Nguyen
*Attorney, Agent, or Firm*—Bachman & LaPointe

[57] ABSTRACT

The invention relates to a pitched roof building system having a roof with a ridge and two roof portions flanking the ridge on opposite sides thereof, which comprises first and second opposed end members of rigid construction, at least one intermediate frame member comprising a number of elements including a first upright column, a first sloping rafter a second sloping rafter and a second column wherein the elements of the or each intermediate frame member are interconnected seriatim by means of flexible joints, and a respective roofing diaphragm is connected to each roof portion such that the roofing diaphragms have inner lateral edges adjacent to one another along the ridge of the roof.

10 Claims, 9 Drawing Sheets

BUILDING SYSTEM

BACKGROUND OF THE INVENTION

The present invention relates to a building system.

SUMMARY OF THE INVENTION

In accordance with one aspect of the present invention there is provided a pitched roof building system having a roof with a ridge and two roof portions flanking the ridge on opposite sides thereof, which comprises a first and second opposed end members of rigid construction, at least one intermediate frame member comprising a number of elements including a first upright column, a first sloping rafter, a second sloping rafter and a second column wherein the elements of the each intermediate frame member are interconnected seriatim by means of flexible joints, and a respective roofing diaphragm is connected to each roof portion such that the roofing diaphragms have inner lateral edges adjacent to one another along the ridge of the roof.

BRIEF DESCRIPTION OF THE DRAWINGS

The present invention will be described, by way of example, with reference to the accompanying drawings in which.

DETAILED DESCRIPTION

Figure 1A:
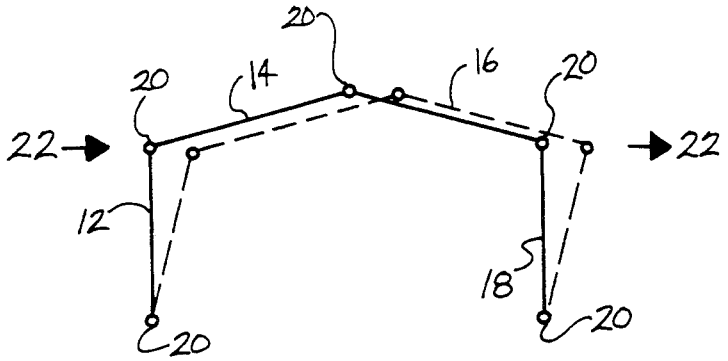
FIG. 1*a* is a schematic end elevation of an intermediate frame member of the present invention under a lateral load.

In FIG. 1*a*, there is shown a frame member 10 comprising a number of elements in the form of a first upright Column 12, a first sloping rafter 14, a second sloping rafter 16 and a second upright column 18. The elements 12, 14, 16, and 18 are connected seriatim to one another by flexible notionally pinned joints 20 with little capability of withstanding load. Also the lower ends of the columns 12 and 18 are mounted on flexible pinned joints 20.

Thus, the frame member 10 is not structurally rigid. This means that if a lateral load as shown by the arrows 22 is applied to the frame member 10 the flexible joints 20 allow the elements to pivot about the flexible joints 20 so that the frame member 10 can, for example, adopt the position shown in phantom in FIG. 1*a.*

Typically, as will be described, a number of the frame members 10 are arranged parallel to one another. Further, the frame members 10 form intermediate members which are located between a pair of gable members 24 such as that shown in FIG. 1*c*. As can be seen in FIG. 1*c*, the gable members 24 comprise a first upright column 26, a first sloping rafter 28, a second sloping rafter 30 and a second upright column 32. The elements 26, 28, 30 and 32 are also connected seriatim. However, the gable member 24 also comprises a column bracing 34 extending from ground level up to the ridge of the roof and diagonal bracing 36 extending from the apex of the gable member 24 to the base of a respective column 26 or 32. When the gable member 24 is subjected to the lateral loads indicated by the arrows 22 the forces in the elements in the gable member are resolved as shown by the arrows in FIG. 1*c.*

Figure 1B:
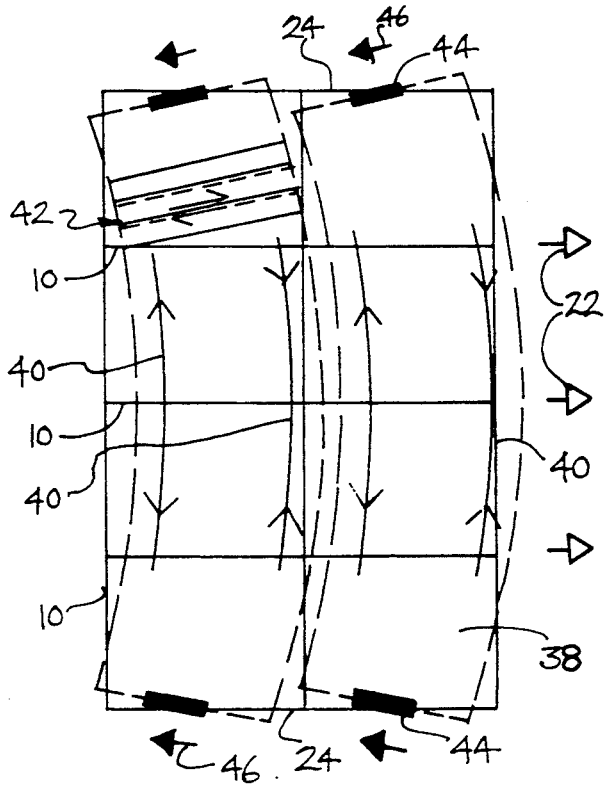
FIG. 1*b* is a schematic plan view of a building system including a number of frame members of FIG. 1*a;*
Figure 1C:
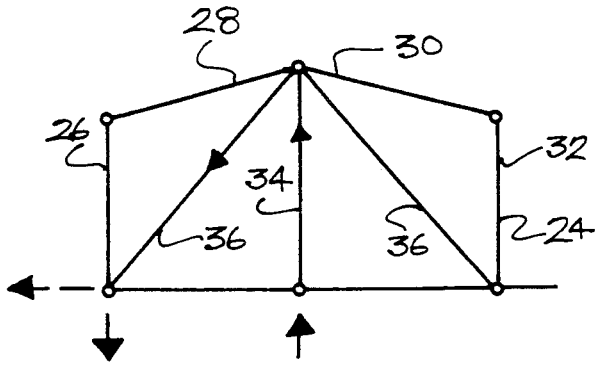
FIG. 1*c*is an end elevation of a rigid gable member for use with the frame member of FIG. 1*a;*

The frame members 10 and the gable members 24 have roofing diaphragms 38 connected respectively to the rafter members 14 and 28 and 16 and 30 such that the roofing diaphragms 38 extend from end to end of the structure as seen in FIG. 1*b.*

The roofing diaphragms 38 are connected to the rafters 14 and 16 by means of purlins 40 in known manner by means of screws or bolts.

Further, each roofing diaphragm 38 is typically formed from a plurality of sheets which are joined together along seams 42 in known manner by means of screws. Also, the roofing diaphragms 38 are connected to the gable members 24 by means of shear connectors 44. The roofing diaphragms 38 meet at the apices of the frame members 10.

Under the lateral load shown by the arrows 22 in FIG. 1*a*, the roofing diaphragms 38 tend to distort in the manner shown FIG. 1*a*. This leads to reactions in the shear connectors 44 shown lead by the arrows 46 in FIG. 1*b.*

Further, the purlins 40 carry flexural tendon forces of the roofing diaphragms 38. The seams 42 carry the diaphragms' 38 in plane shear forces generated by lateral loads.

Thus, the tendency of the frame members 10 to move under lateral loads is resisted by the roofing diaphragms 38 and the reactions set up in the connections of the roofing diaphragms 38 which are translated via the shear connectors 44 into the gables 24. This confers rigidity on the intermediate frame members 10 and confers stability on the entire structure.

Thus, when lateral loads are applied to the intermediate frame members 10 as shown in figure la, instead of the frame members 10 swaying about the flexible joints 20, the forces are resolved through the roofing diaphragms 38, the connections of the roofing sheets to one another, the connections to the gable members 24 and the elements of the gable members 24.

Figure 2A:
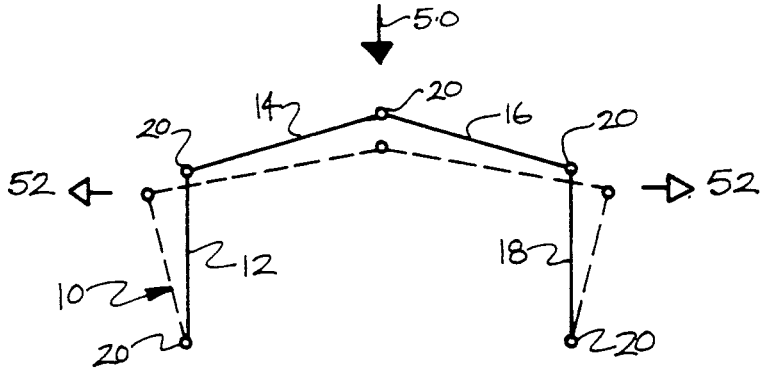
FIG. 2*a* is a schematic end elevation of an intermediate frame member of the present invention under a downward load.
Figure 2B:
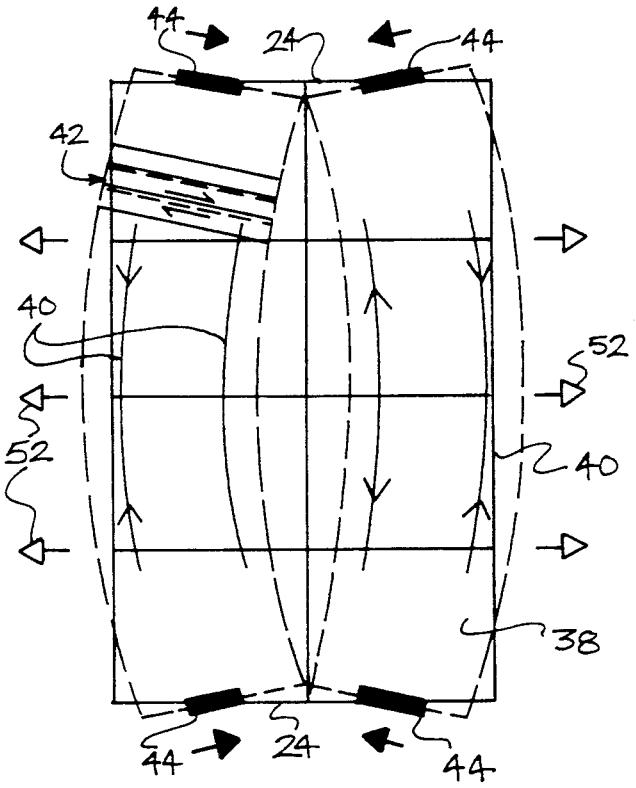
FIG. 2*b* is a schematic plan view of a building system including a number of the frame members in FIG. 2*a.*
Figure 2C:
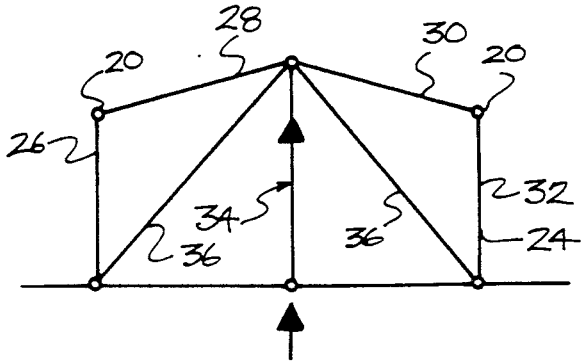
FIG. 2*c* is an end elevation of a rigid gable member for use with the frame member of FIG. 2*a;*

The structure shown in FIG. 2 is the same as shown in FIG. 1 and like reference numerals denote like parts. In this case the intermediate frame is subject to a downward vertical load as shown by the arrow 50. This tends to cause the flexible joints 20 especially those between the columns 12 and rafters 14 and the columns 18 and rafters 16 to pivot so that the joined members move relative to one another and the rafters are lowered whilst the columns are sloped outwardly as indicated by the arrows 52. The resultant reactionary forces in the gable members 24, are shown by the arrows in FIG. 2*c*.

As shown in FIG. 2*b* the roofing diaphragms 38 tend to bow outwardly away from the ridgeline of the roof. This sets up reactionary forces in the end shear connectors 44 as shown by the arrows in FIG. 2*b* adjacent to the connectors 44.

Figure 3:
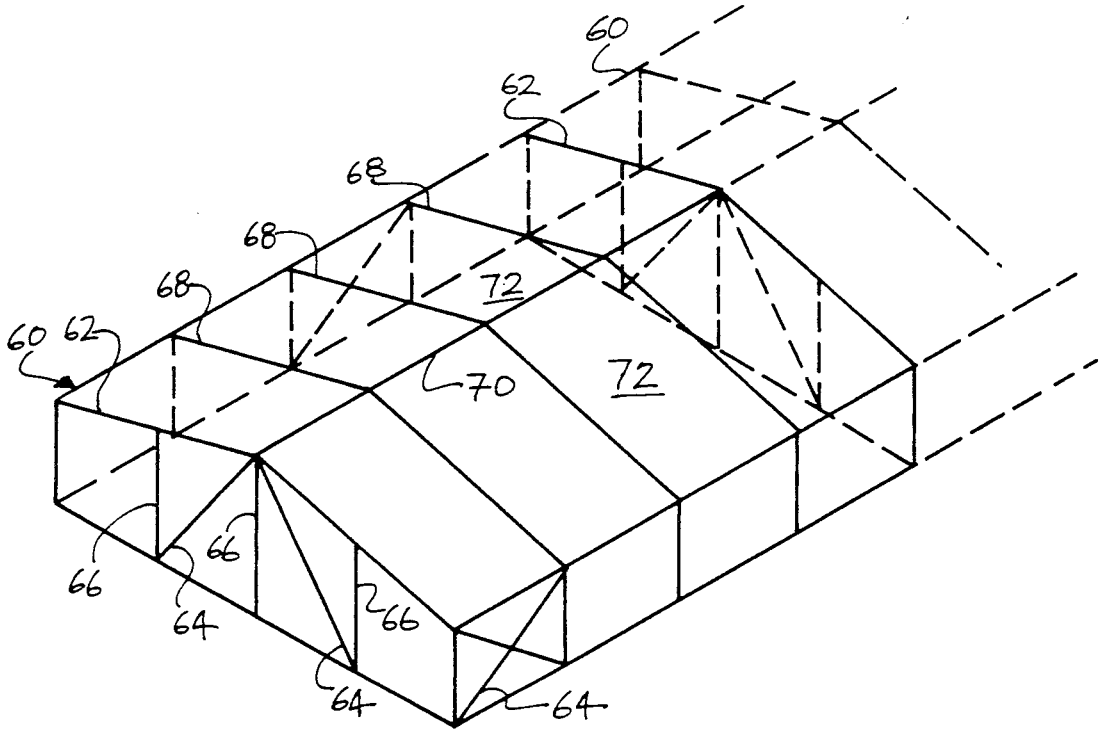
FIG. 3 is an upper perspective view of one form of building structure produced in accordance with the building system of the present invention.

In FIG. 3, there is shown a typical building construction of a double pitched roofed building. The building construction 60 comprises a pair of end gable members 62 having diagonal bracing members 64 and intermediate column members 66 as required. The columns and braces of the gable members 62 are not essential providing the gable members 62 as a whole are stable. Between the gable members 64 there are located a plurality of internal frame members 68. All of the joints of the frame members 68 are pinned. Each frame member 68 simply comprises a pair of spaced upright columns interconnected by a pair of sloped rafters as shown in FIGS. 1*a* and 2*a*. The rafters thus span from the the eaves to ridge 70 of the building construction. However, it should be noted that it is not essential for the roof pitches to be equal. Thus, the rafters could be of different lengths. Further, each ridge 70 is flanked by a pair of roof portions 72 which slope downwardly away from the ridge 70 on opposite sides thereof.

As described in relation to FIGS. 1 and 2, roof diaphragm forces are transferred to the rafters by shear connectors. As indicated in FIG. 3, two or more building constructions 60 may be joined end to end to form an elongated composite structure. However, within each building construction 60 there are no downwardly extending members between the gable members 62 and the columns of the frame members 68.

Figure 4:
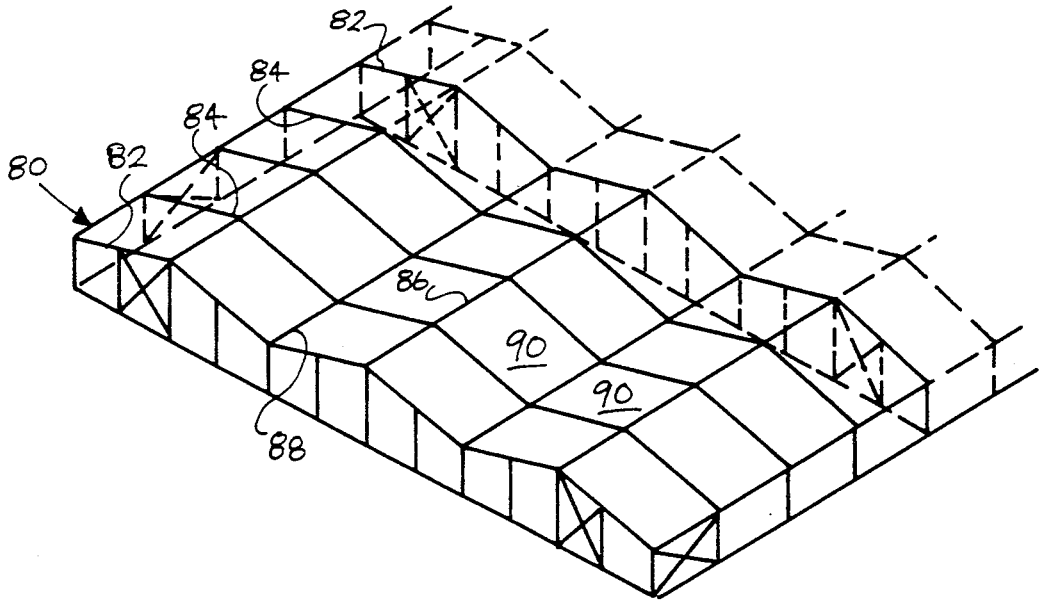
FIG. 4 is an upper perspective view of another form of building structure produced in accordance with the building system of the present invention.

The arrangement seen in FIG. 4 is similar to that of FIG. 3, except that a building construction 80 which is shown has a multiple pitch roof. The building construction 80 comprises end gable members 82 and internal frames 84 which are of similar construction to the equivalent members of the building construction 60 of FIG. 1, except that each internal frame 84 comprises a multiplicity of pairs of rafters. However, as with the building construction 60 of FIG. 3, there are no downwardly extending members between the gable members 82 and the columns of the internal frames 84. The width of the building construction 80 of FIG. 4 can be very large and can have a large number of roof pitches having ridges 86 and valleys 88. For example, a building construction 80 can be about 100 meters wide and about 35 meters long (between the members 82). The ridges 86 are flanked by pairs of roof portions 90 which slope downwardly away from the ridges 86 to the valleys 88. Further, a number of the building constructions 80 can be joined end to end to form an elongated composite structure.

Figure 5:
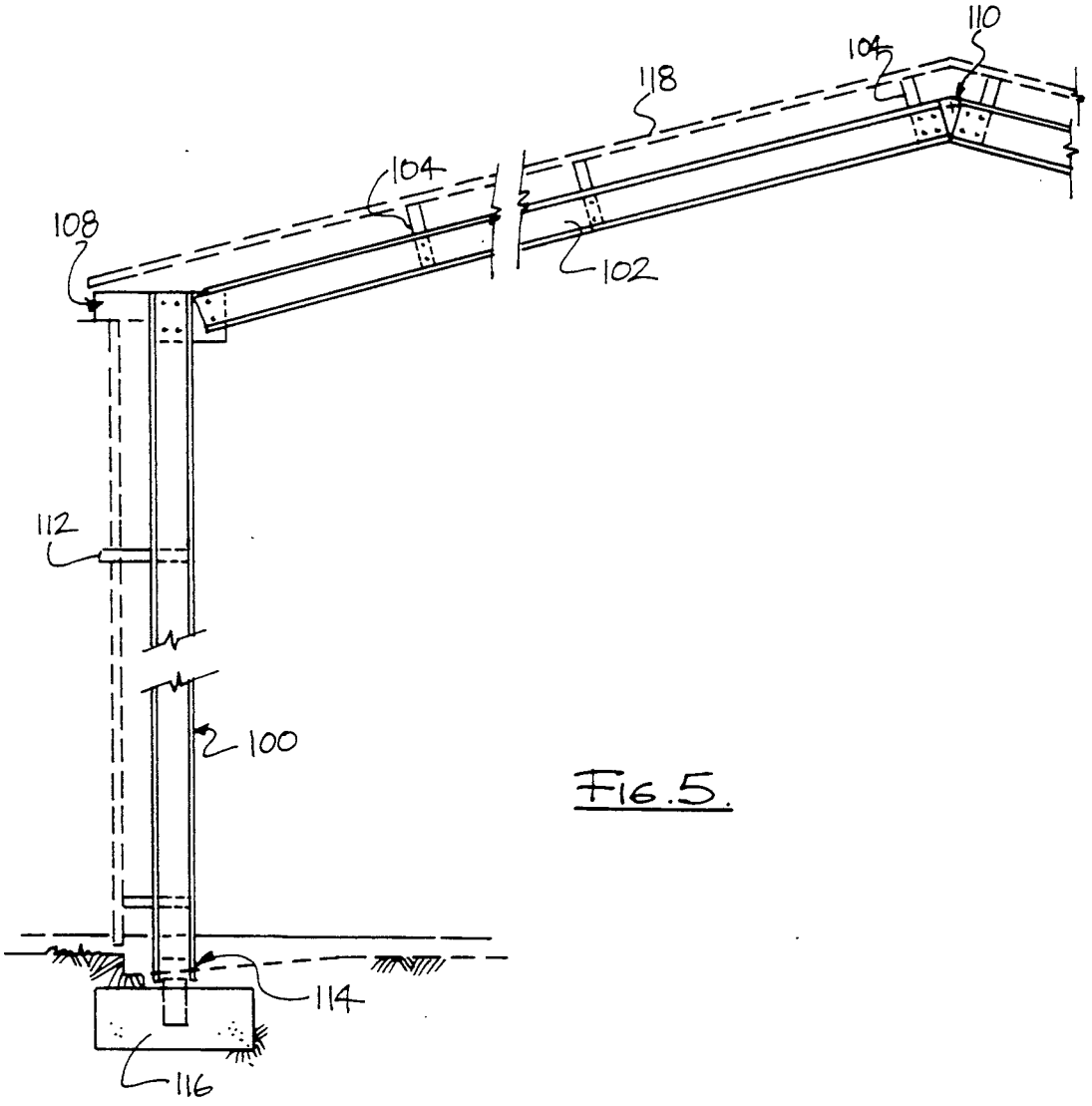
FIG. 5 is a partial sectional view through a part of a building as shown in FIGS. 3 and 4 showing the construction of a frame member in more detail.

A typical internal frame arrangement of the present invention can be seen in FIG. 5. The frame arrangement comprises columns 100 formed of channel sections bolted back-to-back and rafters 102 made up of channel sections bolted back-to-back. Longitudinally extending purlins 104 are mounted on top of the rafters 102 by means of purlin cleats. The purlins 104 may be of Zed section. A column-rafter cleat 108 in the form of a plate is sandwiched between the channels at the upper ends of columns 100 and the outer ends of rafters 102. As indicated, the rafter cleats 108 are bolted to the adjacent portions of the columns 100 and rafters 102.

Further, an apex cleat 110 in the form of a plate is sandwiched between the channels at the inner ends of each pair of opposite rafters 102. The apex cleat 110 is also bolted to the adjacent portions of the rafters 102. Provision is made for mounting of wall sheeting by means of outwardly extending girts 112 fixed to the columns 100. However, if the building construction is to have open sides the girts 112 can be omitted.

The columns 100 are mounted on base plates 114 which may comprise a vertical division plate welded to a horizontal base plate. The base plates 114 are bolted to the lower ends of the columns 100 and are mounted on concrete pad footings 116. Roofing sheets 118 are mounted on top of the purlins 104 by known means.

Figure 6:
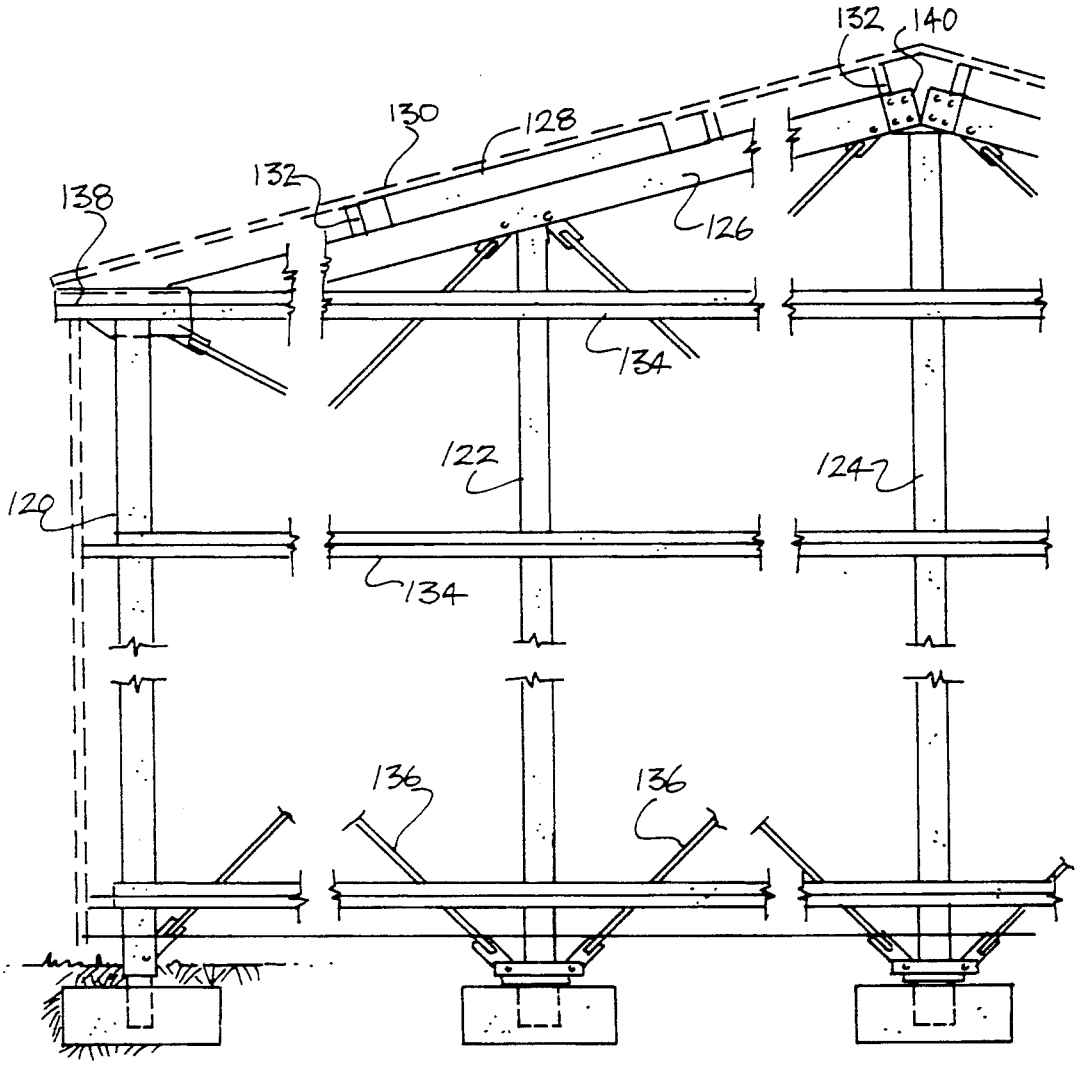
FIG. 6 is a partial end elevation of a building as shown in FIGS. 3 and 4 showing the construction of a gable member in more detail.

In FIG. 6, there is shown a typical gable frame arrangement of a construction in accordance with the present invention. The gable frame arrangement of FIG. 6 is in general terms of known construction. The system seen in FIG. 6 comprises a corner column 120, an intermediate gable column 122, and a ridge column 124. The upper ends of the columns 120, 122, and 124 are connected to a gable rafter 126.

Shear connectors 128 formed of channel sections bolted back-to-back are bolted to the upper flanges of the gable rafters 126 and act to secure roof sheets 130 to the rafters 126 in addition to connections via purlins 132. The roof sheets 130 may be screwed to the shear connectors 128.

Girts 134 may be provided for mounting of wall cladding. Steel rod braces 136 may be provided as required to confer stability on the gable member. Further, the eaves level girt 134 is preferably cleated to a fascia purlin 138 to assist in transferring brace forces. There is also a gable apex cleat 140 which connects the gable rafters 126 to one another and the ridge column as well as being connected to the ridge purlins 132.

The columns and rafters of the building construction of the present invention are typically formed of metal such as steel. The internal frame members rely on their connection to the roof members to achieve sufficient structural stability and in this context the roof diaphragms act as stressed skins.

Figure 7:
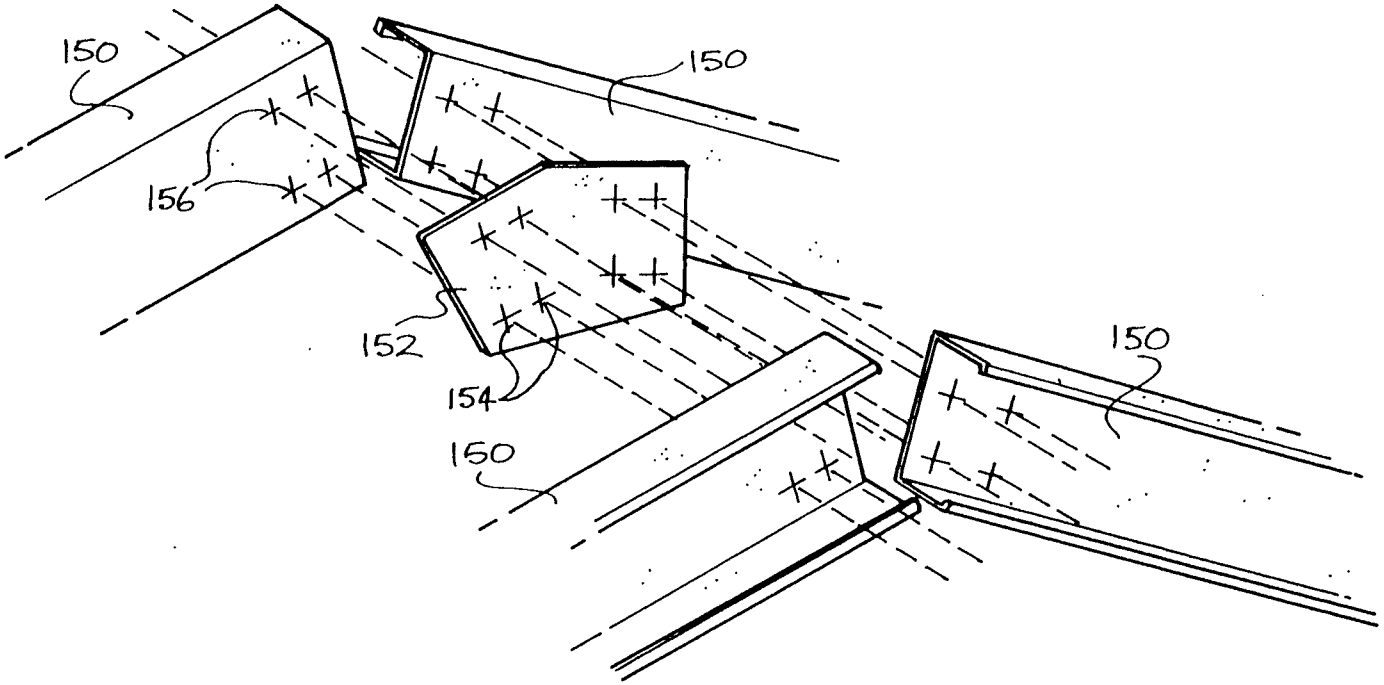
FIG. 7 is an exploded perspective view to an enlarged scale of an apex-rafter joint of the present invention.

In FIG. 7 there is shown to a larger scale an apex-rafter connection which has been found to be useful in the building construction of the present invention such as the internal frame element of FIG. 5.

As shown in FIG. 7 the apex-rafter connection comprises four C-section construction members 150 which in use are bolted together back to back in pairs to form rafters. As shown, the rafters are sloped upwardly towards the ridge of the roof of the building construction. At their inner ends at the apex of the roof the rafters are interconnected solely by a thin plate 152 which is sandwiched between the opposed pairs of members 150 forming two rafters shown in the drawing. The plate 152 contains a plurality of apertures 154 and the C-section members 150 have a corresponding plurality of apertures 156.

The plate 152 may be about 5 mm thick and formed of mild steel. The plate 152 may be connected to the C-section members 150 by means of M16 bolts secured in place by nuts. The opposed C-section members 150 are thus only 5 mm apart when the rafters are assembled. The inner ends of the rafters are preferably spaced apart by the minimum fabrication tolerance which may be about 10 mm.

Figure 8:
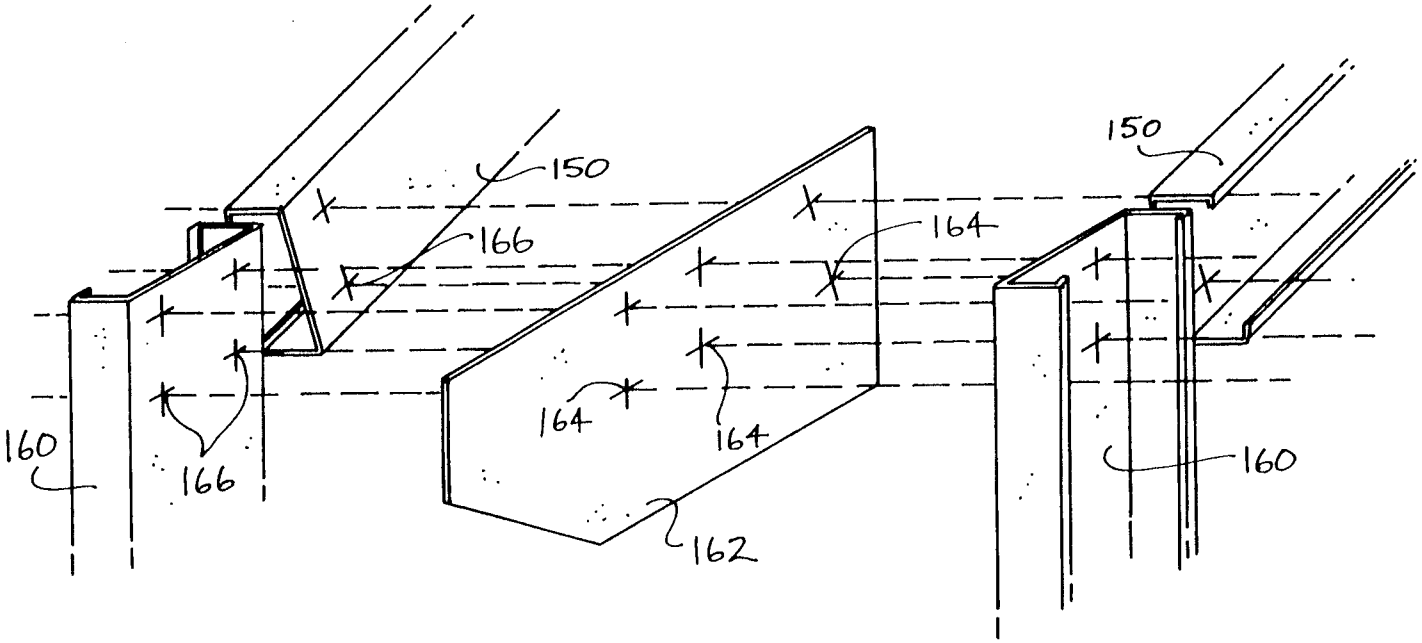
FIG. 8 is an exploded perspective view to an enlarged scale of a column-rafter joint of the present invention.

In FIG. 8, there is shown to a larger scale a column-rafter connection which has been found to be useful in the building construction of the present invention such as the internal frame element of FIG. 5.

As shown in FIG. 8 the column-rafter connection comprises four C-section construction members. Two C-section construction members 150 are bolted together back to back to form a rafter as described above in relation to FIG. 7. Further, two C-section construction members 160 are bolted together back to back to form a column. As shown the rafter slopes downwardly towards the column and the column is upright. The outer end of the rafter and the upper end of the column are interconnected solely by a thin plate 162 which is sandwiched between the opposed pairs C-section construction members 150 and 160 at their adjacent ends. The plate 162 contains a plurality of apertures 164 and the C-section members 150 and 160 have a corresponding plurality of apertures 166.

The plate 162 may be about 5 mm thick and formed of mild steel. The plate 162 may be connected to the C-section members 150 and 160 by means of M16 bolts secured in place by nuts. The opposed C-section members are thus only 5 mm apart when the rafter and column is assembled. The rafter and the column are preferably spaced apart by the minimum fabrication tolerance which may be about 10 mm.

Figure 9:
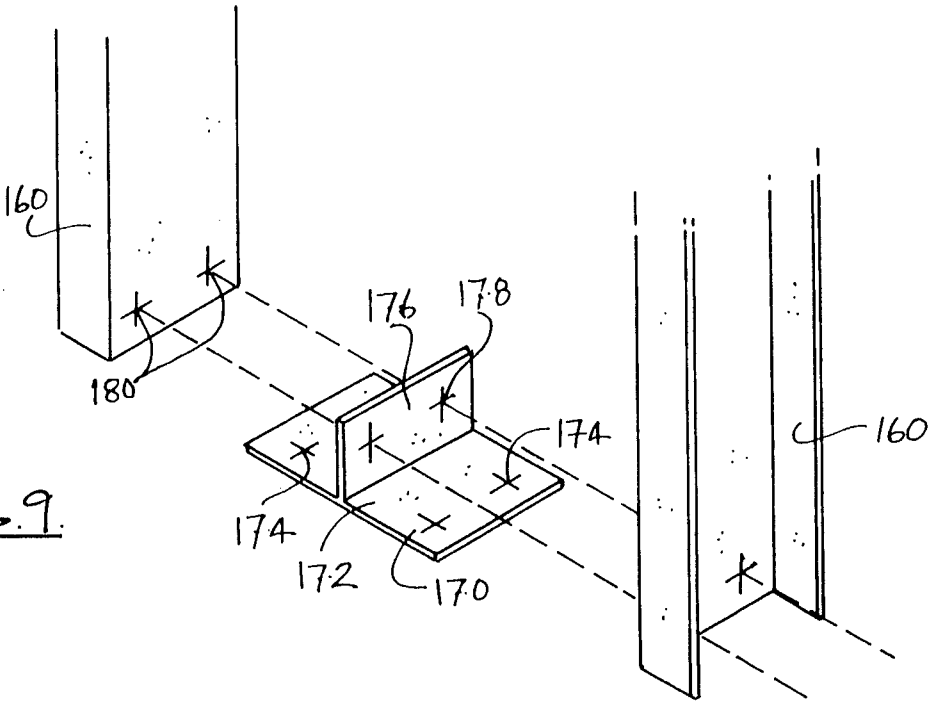
FIG. 9 is an exploded perspective view to an enlarged scale of a base plate-column joint of the present invention.

In FIG. 9, there is shown to a larger scale a base plate-column connection which has been found to be useful in the building construction of the present invention such as the internal frame element of FIG. 5.

As shown in FIG. 9 the base-plate-column connection comprises two C-section construction members 160 which are connected together back to back to form a column. Further, there is a base plate 170 which comprises a flat foot 172 containing a plurality of holes 174. The base plate 170 is arranged to be mounted on a flat base such as a concrete footing pad by suitable fastening means passed through the apertures 174 in the foot 172. A laterally extending upstanding plate 176 is mounted on the foot 172 mid way between opposite ends thereof.

The plate 176 contains a pair of apertures 178 and the column members 160 contain corresponding pairs of apertures 180.

The plate 176 may be about 5 mm thick and formed of mild steel. Further, the column is solely connected to the base plate 170 by means of bolts passed through the apertures 178 and 180 and secured by nuts.

The connections shown in FIGS. 7, 8 and 9 are flexible pinned joints which are incapable of transmitting significant moment because the connecting bolts would shear and/or the thin connecting plate would buckle. The connections are designed to transfer member axial and shear forces only and as such may be considered effectively pinned.

The connection shown in FIG. 9 could be replaced by a rigid connection in which the lower end of the column was rigidly mounted such as by being embedded in a concrete footing.

The rafters of the internal frame arrangements may be built up at ground level and then lifted up by a crane and fastened to the upper ends of columns already in place. The connection plates used to form the flexible pinned joints may be pregalvanized or painted after fabrication. These connection plates are preferably from 4 to 10 mm thick. The C-section members are typically pre-galvanised.

Figure 10:
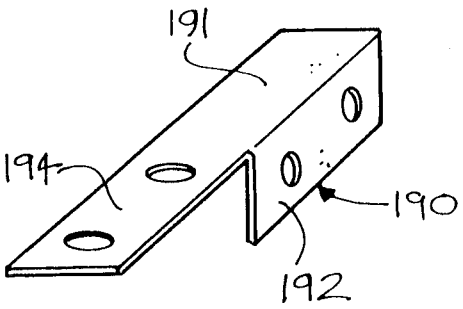
FIG. 10 is a perspective view of a purlin and girt cleat which may be used in the present invention.

The roof sheeting can be formed from roll formed steel sheeting which is fastened using self tapping screws. The sheets are typically fastened together and then the so formed roofing diaphragm is fastened to shear connectors. A typical purlin and girt cleat 190 is shown in FIG. 10. The cleat 190 has an angle section portion 191 having an aperture flange 192 arranged to mate with a correspondingly apertured face of a purlin or girt. Further, there is an apertured flat extension 194 leading from the angle section portion 191. The extension 194 is orientated at 90° to the flange 192 and is arranged to fit between a pair of correspondingly apertured C-section members forming a rafter on a column as shown, for example, in FIGS. 7 to 9. The cleat 190 is secured to the purlins and C-section members by means of bolts passed through corresponding pairs of apertures and secured in place by nuts. Modifications and variations such as would be apparent to a skilled addressee are deemed within the scope of the present invention.

For example, the frame work gable members described herein can be replaced by any convenient stable structure such as a concrete wall.

I claim:

1. A pitched roof building system having a roof, a ridge dividing the roof into two opposite sides and two roof portions flanking the ridge on said opposite sides, which comprises first and second opposed rigid end members of rigid construction, at least one intermediate frame member comprising a number of elements including a first upright column, a first sloping rafter, a second sloping rafter and a second upright column, said first sloping rafter being spaced from said second sloping rafter, the elements of the at least one intermediate frame member being interconnected seriatim by means of flexible joints between said first upright column and said first sloping rafter, between said first sloping rafter and said second sloping rafter, and between said second upright column and said second sloping rafter, said flexible joint between said first and second sloping rafters being formed by a metal plate between said spaced apart first and second sloping rafters, each upright column having a lower and which is connected to a footing by a flexible joint, said at least one intermediate member being totally flexibly mounted, and a respective roofing diaphragm connected to each roof portion such that the roofing diaphragms having inner lateral edges adjacent to one another along the ridge of the roof.

2. A pitched roof building system according to claim 1, in which the flexible joints are flexible pinned joints.

3. A pitched roof building system according to claim 1, in which each of said flexible joints comprises at least a pair of construction members which are interconnected solely by means of a thin plate which has apertures therein arranged to mate with corresponding apertures in the construction members and bolts are passed through mating apertures and are secured by nuts.

4. A pitched roof building system according to claim 1, in which the end members are in the form of gable members constituted by a framework.

5. A pitched roof building system according to claim 1, in which each roofing diaphragm is formed by a plurality of sheets joined together along seams.

6. A pitched roof building system according to claim 1, in which the roofing diaphragms are connected to the end members by means of shear connectors.

7. A pitched roof building system according to claim 1, in which there are a number of longitudinally extending purlin members atop the rafters and the roofing diaphragms are connected to the rafters by means of the purlin members.

8. A pitched roof building system according to claim 1, in which there are more than two of the rigid end members arranged in a row and there is at least one intermediate frame member disposed between each pair of end members.

9. A pitched roof building system according to claim 1 in which there are a number of parallel ridges separated by valleys.

10. A pitched roof building construction according to claim 1, in which there are no intermediate supporting members within the volume defined by the end members and the columns.

* * * * *